United States Patent [19]

Sugiyama et al.

[11] 4,237,828

[45] Dec. 9, 1980

[54] METHOD OF CONTROLLING AN INTERNAL COMBUSTION ENGINE

[75] Inventors: Keiichi Sugiyama, Shizuoka; Hiromitsu Matsumoto, Hamamatsu, both of Japan

[73] Assignee: Yamaha Hatsukoko Kabushiki Kaisha, Iwata, Japan

[21] Appl. No.: 971,740

[22] Filed: Dec. 21, 1978

[30] Foreign Application Priority Data

Dec. 26, 1977 [JP] Japan ..... 52-159409

[51] Int. Cl.[3] ..... F02B 3/02; F02P 5/06

[52] U.S. Cl. ..... 123/262; 123/418; 123/308 123/75 B

[58] Field of Search ..... 123/30 C, 30 D, 75 B, 123/119 D, 119 DB, 119 A, 124 R

[56] References Cited

U.S. PATENT DOCUMENTS

| | | | |
|---|---|---|---|
| 2,244,214 | 6/1941 | Pescara | 123/75 B |
| 3,418,981 | 12/1968 | Von Seggern et al. | 123/75 B |
| 3,678,905 | 7/1972 | Diehl | 123/75 B |
| 4,086,885 | 5/1978 | Noguchi et al. | 123/75 B |
| 4,095,569 | 6/1978 | Waketa et al. | 123/30 C |
| 4,133,322 | 1/1979 | Nakamura et al. | 123/30 C |
| 4,164,205 | 8/1979 | Asanomi et al. | 123/117 R |
| 4,164,914 | 8/1979 | Hattori et al. | 123/119 DB |
| 4,174,686 | 11/1979 | Shimizu et al. | 123/75 B |
| 4,181,105 | 1/1980 | Takemoto et al. | 123/117 R |

*Primary Examiner*—P. S. Lall

*Attorney, Agent, or Firm*—Ernest A. Beutler

[57] ABSTRACT

Several embodiments of internal combustion engines each having an arrangement for increasing turbulence in the combustion chamber under at least certain load and/or speed conditions so as to permit the use of a relatively simple spark advance mechanism. In each embodiment, the flame propogation is controlled by controlling the degree of turbulence to achieve the desired effect. The turbulence is generated by causing induction of at least a portion of the engine charge requirements through a relatively small cross sectional area auxilliary induction passage. Because of the small cross sectional area, high flow velocities are generated which are maintained in the combustion chamber. In accordance with certain embodiments of the invention, the degree of turbulence is controlled by either shunting some of the air flow through the main induction passage or by introducing controlled amounts of exhaust gas products. In accordance with another embodiment of the invention, the associated distributor is provided with two pairs of contact points each of which provides a different spark advance and a control circuit for selecting the appropriate set of contact points to set the particular running condition of the engine.

13 Claims, 9 Drawing Figures

METHOD OF CONTROLLING AN INTERNAL COMBUSTION ENGINE

BACKGROUND OF THE INVENTION

This invention relates to an internal combustion engine and method of operating such engine so as to improve performance.

As is well known, internal combustion engines in most applications are called upon to run over a wide variety of speed and load ranges. This is particularly true when the engine is used in an automotive application. In connection with spark ignited engines, a distributor and advance mechanism is provided for firing the spark plugs at a pre-determined timing in relation to the crank or output shaft angle. As with many components of the engine and its design, the chosen point of spark firing at a given speed and/or load condition is a comprise dictated by the difficulty and cost of providing optimum timing at all conditions. As a result, performance with conventional engines suffers under at least some of these running conditions.

Conventional distributors, which may be of either the contact point or solid state type embody both governor and vacuum advance devices. The governor advance provides spark timing in relation to engine speed while the vacuum advance mechanism compensates to some extent the changes in load. Of course, the use of such combined advance mechanisms compensates the structure, adds to its cost and introduces the possibility of unreliability. Further, even the use of these two advance mechanisms does not provide the appropriate or necessary degree of control.

As a specific example of this problem, the distributors used with conventional engines provide something less than optimum advance characteristics at idle and low load conditions. With conventional engines, the rate of flame propogation in the combustion chamber is extremely low under idling. Thus, to insure complete combustion and smooth and efficient running considerable spark advance should be employed at idle. However, if a high degree of initial advance at idle is provided, the likelihood of pre-ignition at higher load and speed ranges is greatly increased. Thus, it has been the practice to provide a substantially reduced spark advance at idle so as to reduce the likelihood of pre-ignition at higher speeds and load ranges. Furthermore, it has been the practice recently to severely retard the idle spark advance (even after top dead center T.D.C.) to attempt to control the amount of nitrous oxide in the exhaust gas. Of course, this provides extremely inefficient low speed operation as well as introducing the likelihood of extremely rough running.

It is, therefore, a principle object of this invention to provide an internal combustion engine and method of operating it which controls the rate of combustion under specified load and/or speed ranges so as to permit a simpler spark advance mechanism and at the same time provide better control of this characteristic.

As has been previously noted, it has been the practice to provide both vacuum and governor advance mechanisms with conventional distributors in an effort to obtain more accurate control under all running conditions. It is another object of this invention to provide a distributor spark advance mechanism which permits varying spark advance characteristics without necessitating the incorporation of a vacuum advance mechanism.

SUMMARY OF THE INVENTION

A first feature of this invention is adopted to be employed in a spark ignited internal combustion engine having a variable volume chamber in which combustion occurs, a spark plug for firing a charge in the chamber and a distributor for delivering an electrical charge at a timed interval to the spark plug for firing it. The distributor includes advance means for varying the time of delivery of the charge to the spark plug in response to a running characteristic of the engine. The advance means provides a fixed time of spark plug firing at a certain running condition of the engine. In accordance with this feature of the invention, means are provided for increasing the turbulence in the variable volume chamber under the specific running condition sufficiently to cause the rate of combustion in the chamber to produce efficient running in the pre-set time of spark advance.

In accordance with another feature of the invention, a method is provided for operating a spark ignited engine having a chamber, spark plug and distributor as set forth in the preceding paragraph. In accordance with this method, the degree of turbulence in the chamber is controlled at at least one running condition so that the spark advance pre-set by the distributor will be effective to provide efficient running.

In accordance with a still further feature of the invention, a distributor is provided for firing a spark plug in a chamber of the engine. This distributor has two separate selectively operable spark delivering devices for providing different spark advance charges to the spark plug. Means are provided for selecting which of these spark delivery devices provides the spark to the spark plug in response to the requirements of the chamber.

DETAILED DESCRIPTION OF THE PREFERRED EMBODIMENTS OF THE INVENTION

THEORY

As has already been discussed, the efficient running of an engine as well as smoothness and the control of unwanted exhaust gas constituents is depended upon proper spark advance and the maintenance of sufficient turbulence in the combustion chamber so as to provide the desired combustion chacteristics in relation to output shaft angle (crank angle in the case of a reciprocating engine). Although it is desirable to provide a relatively high degree of turbulence at low speeds and particularly idle, to high a rate of turbulence will demand to much spark retardation to permit a simple and low cost distributor to be used. On the other hand, the generation of turbulence tends to diminish volumetric efficiency and is undesirable at the higher load ranges.

Figure 1:
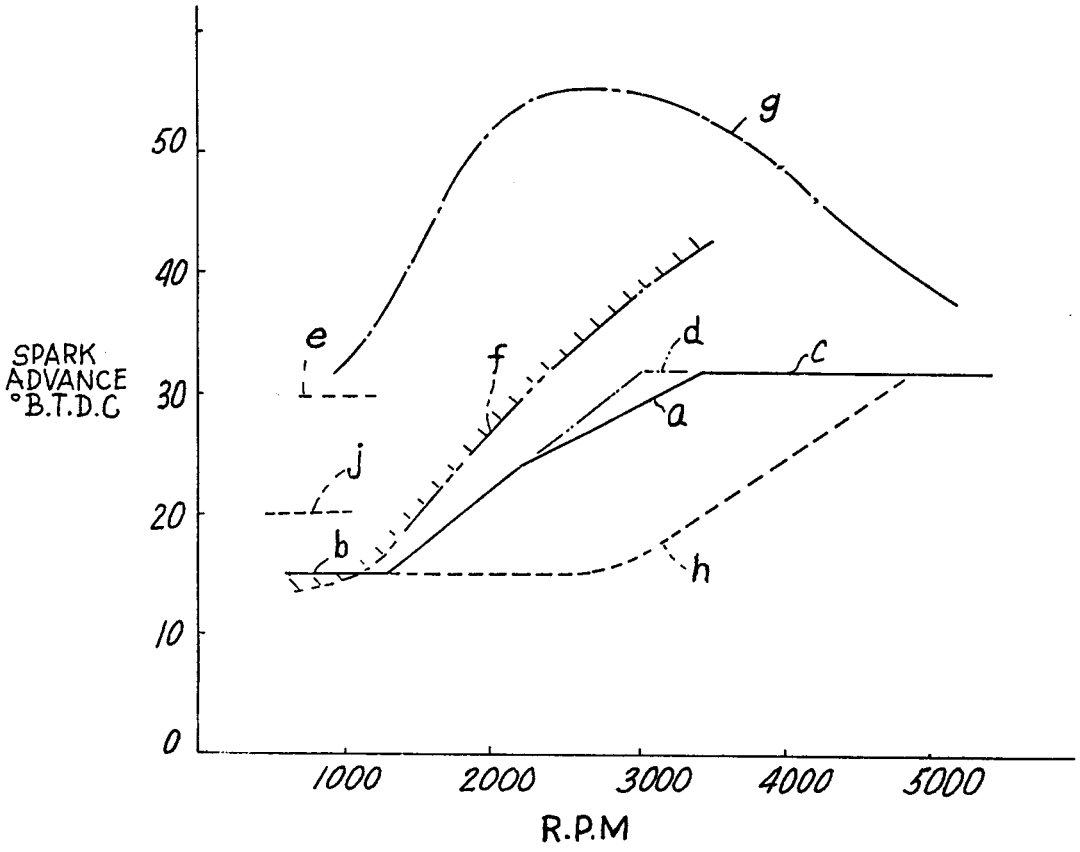
FIG. 1 is a graphical analysis showing the spark advance in relation to speed of an engine in order to describe the theory of this invention.
Figure 2:
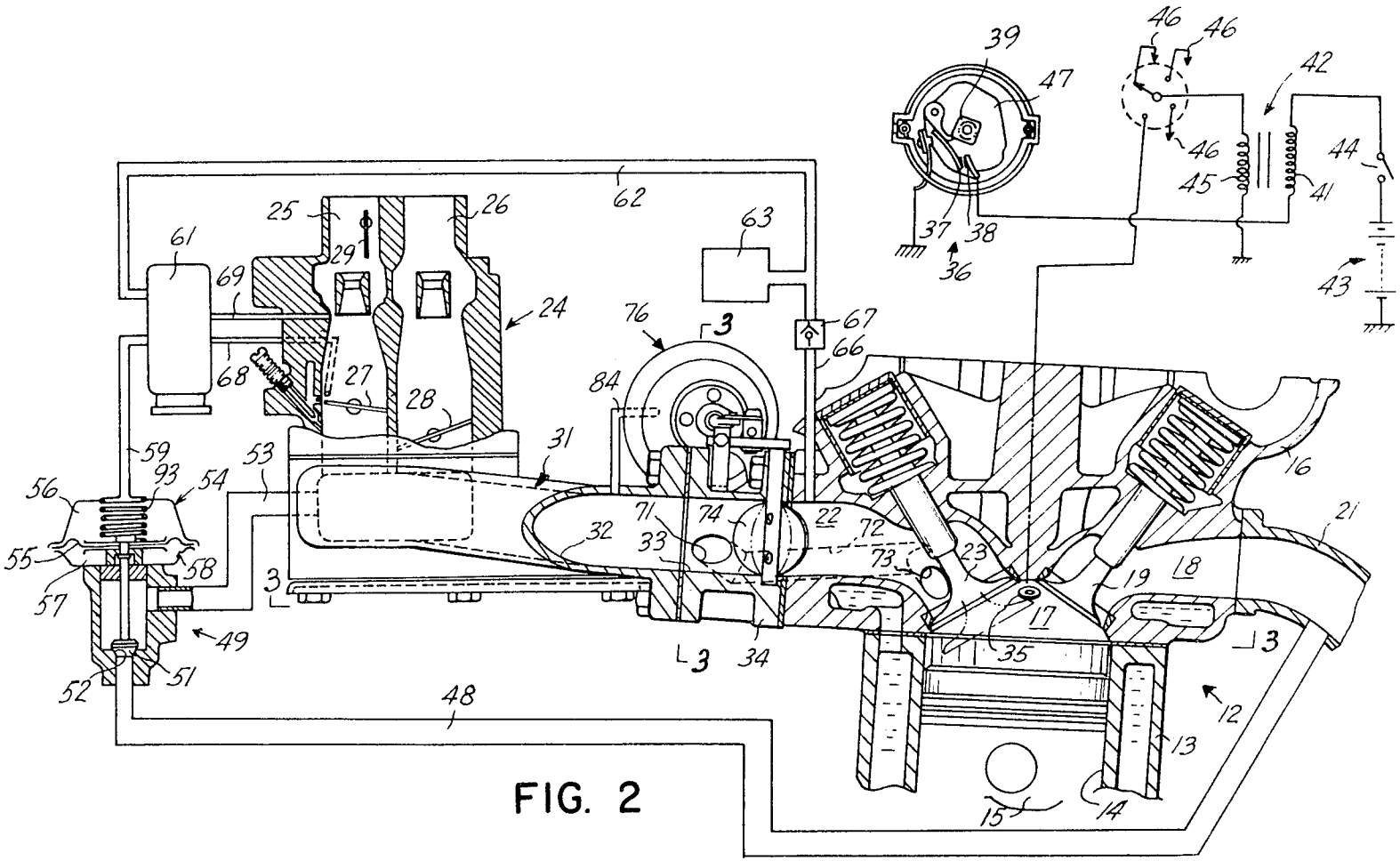
FIG. 2 is a partially schematic cross sectional view taken through a single cylinder of a multiple cylinder internal combustion engine constructed in accordance with a first embodiment of the invention, and generally along the line 2—2 of FIG. 3.
Figure 3:
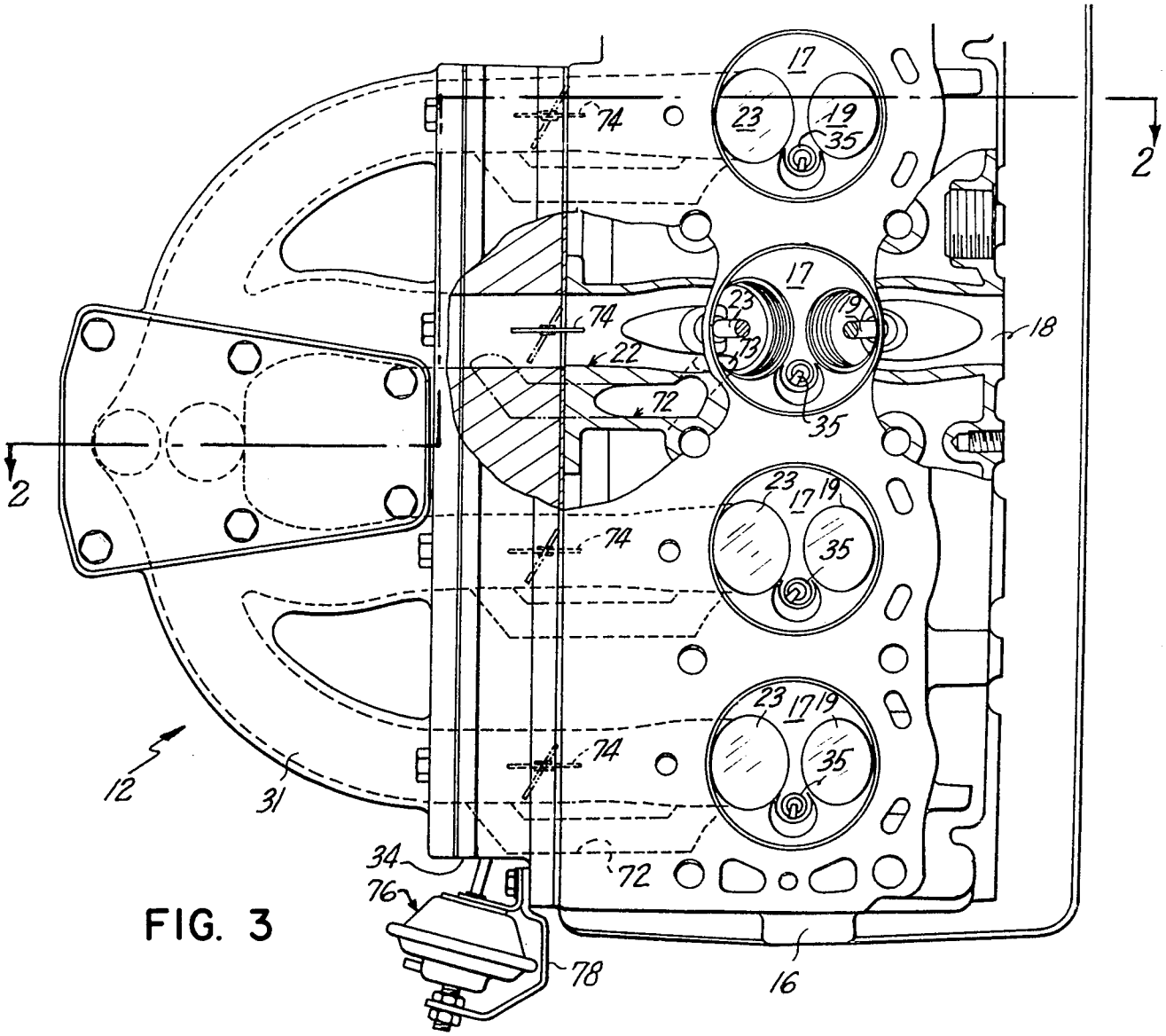
FIG. 3 is a bottom plan view, with portions broken away, of the cylinder head and induction system of the embodiment of FIG. 2 and is taken generally along the line 3—3 of FIG. 2.

Certain of these principles may be best explained by reference to FIG. 1 which is a graphic representation of spark advance in relation to engine speed. In this graph, the spark advance in degrees before top dead center is represented by the absessa and engine speed and revolutions per minute is represented on the ordinate. The spark advance characteristics of a conventional distributor having a governor type advance is identified by the solid line curve a. In this curve, the distributor provides a fixed degree of advance at idle and low load, as represented by the horizontal line b and a fixed degree of advance at the higher engine speeds, as represented by the horizontal line c. In the partial speed ranges between low speed and high speed, the distributor provides a variable degree of advance, which may have a step in it as represented by curve a. Alternately, conventional distributors may provide a complete linear rate of advance as shown by the dot dot dash curve identified by the reference letter d. Because, with conventional engines, the rate of combustion in the chamber at idle and low loads is so slow, it is preferable to provide considerable spark advance under this condition. The optimum spark advance is represented by the broken line horizontal curve e in FIG. 1. This degree of advance is normally something in the range of 25 to 30 degrees before top dead center. As will be apparent from FIG. 1, the conventional distributor only provides a spark advance of about 15 degrees before top dead center under this condition. In fact, in order to control nitrous oxide in the exhaust gases, devices are conventionally used in conjunction with distributors to provide further spark retardation under idling. It is not uncommon with some engines to delay the spark timing until as much as 5 degrees after top dead center. Of course, this greatly reduces efficiency and increases the likelihood of rough running.

Another reason for providing a retarded spark at idle is to avoid the possibility of pre-ignition. Since the degree of advance at idle with a conventional governor spark advance mechanism determines the spark advance at all other speed conditions, this retardation is necessary so as to avoid operation in the pre-ignition zone, as identified by the curve f in FIG. 1. In order to partially compensate for this comprise in spark advance, many distributors embody a vacuum advance mechanism which operates along a curve as represented by the dot dash line g in FIG. 1. The effect of the vacuum advance is superimposed upon the governor advance characteristics. As has been noted, this mechanism complicates the construction of the distributor.

In accordance with a feature of this invention, the rate of combustion in the chamber is controlled by introducing a large degree of turbulence. As will become apparent in connection with the discussions of certain embodiments of the invention, this turbulence is generated by introducing a substantial portion of engine charge requirements at idle and low speed through a relatively small cross sectional area auxilliary induction passage. As a result of the use of such a small cross sectional area induction passage, the velocity of the inducted charge is increased and turbulence is promoted in the combustion chamber at the time of ignition. This turbulence increases, to a desired extent, the rate of flame propogation.

If the turbulence generated in the combustion chamber at the time of ignition is to great, flame propogation may be so rapid as to demand a delay in the spark advance at low and partial loads. Referring again to FIG. 1, this characteristic is shown by the broken line curve h. In accordance with another feature of this invention, means are provided for controlling the amount of turbulence so as to permit the use of conventional distributor having only governor advance mechanisms resulting in advance characteristics shown by the curves a or d. As will become apparent in conjunction with the description of the preferred embodiments, the amount of turbulence is controlled by shunting part of the charge requirement delivery to the chamber through the larger main induction passage or by controlling the amount of exhaust gas recirculation so as to slow down the rate of combustion. Of course, combinations of these two methods may be employed in a given engine.

EMBODIMENTS OF FIGURES 1 THROUGH 5

The described theory may be understood by reference to FIGS. 1 through 5, wherein a multiple cylinder internal combustion engine constructed and operating in the principle of this invention is identified generally by the reference numeral 12. The engine 12 is of the multiple cylinder spark ignited reciprocating type. The engine 12 includes a cylinder block 13 having a plurality of cylinder bores 14 in which pistons 15 are supported for reciprocation. A cylinder head 16 is affixed to the cylinder block 13 and is provided with chambers 17 that cooperate with the pistons 15 and cylinder bores 14 to provide chambers of variable volume in which combustion occurs.

Exhaust passages 18 are formed in one side of the cylinder heat 16 and communicate with each of the respective chambers 17. Exhaust valves 19, which are operated in any known manner, control the flow through the cylinder head exhaust passages 18. The exhaust gases are discharged from the cylinder head exhaust passages 18 through an exhaust manifold 21 and appropriate exhaust system (not shown).

A charge for the chambers 17 is provided through main cylinder head intake passages 22 which are formed in the cylinder head 16 on the side opposite the exhaust passage 18. Intake valves 23, which are operated in any known manner, control the communication of the intake passages 22 with the chambers 17.

A charge for the chamber 17 is formed by an appropriate charge forming device, such as a carburetor, indicated generally by the reference numeral 24. The carburetor 24 is of the two barrel staged type and includes a primary barrel 25 and a secondary barrel 26.

Throttle valves 27 and 28 are positioned in the barrels 25 and 26, respectively, for controlling the flow through of these barrels. The throttle valves 27 and 28 are controlled by the operator of the engine in a known manner and are opened in a progressive manner, by any known mechanism such as a linkage or automatic secondary throttle valve opener. In addition, fuel supply means are provided for each barrel 25 and 26 which is also conventional and, therefore, not described. As is also known with this type of carburetor, a choke valve 27 is provided only in the primary barrel 25.

The carburetor 24 delivers a charge to the chamber 17 via an intake manifold indicated generally by the reference numeral 31. The intake manifold 31 has a plurality of runners 32 which communicate with respective of the cylinder head intake passages 22 via passages 33 formed in a valve block 34 which is interposed between the intake manifold 31 and cylinder head 16, for a reason to be described.

The engine 12 is provided with a spark plug 35 in each of the chambers 17 of the cylinder head 16. The spark plugs 35 are fired by means of a distributor which is shown partially in cross section and partially schematically in FIG. 2 and which is indicated generally by the reference numeral 36. The distributor 36 has a set of contact points 37 and 38 the moveable one of which (37) is opened and closed by means of a cam mechanism 39 fixed to a shaft that is rotated at ½ the speed of the crank shaft of the engine, as is well known. The contact points 37 and 38 make and break a circuit through a primary winding 41 of a spark coil indicated generally by the reference numeral 42. The primary winding 41 is in circuit with a battery 43 by means including an ignition switch 44. The coil 42 also has, as is well known in the art, a secondary winding 45 which delivers a high voltage current to a rotor of the distributor 36 for selective delivery of the spark plugs, via leads indicated schmetically 46.

In accordance with this invention, the distributor 36 has a centrifugal or governor type of advance mechanism which rotates a plate 47 on which the points 37 and 38 are mounted so as to control the spark advance in the manner previously described. To briefly summarize, the distributor 36 provides a pre-determined fixed spark advance at idle and up to partial load requirements in the order of about 15 degrees and a fixed spark advance at the higher engine speeds. Between the partial and high speed, the distributor 36 provides a varying spark advance which may vary either linearly with engine speed or it may have stepped advance.

In conjunction with the described embodiment, the distributor 36 is of the conventional breaker contact, rotor type cooperating with a spark coil. It should be readily apparent that the invention is not specifically limited to this type of spark system but may be also equally as well employed with engines having a solid state of semi-solid state ignition systems.

The engine 12 is provided with an exhaust gas recirculation system for controlling the emissions of nitrous oxide and for controlling the rate of combustion in the chamber 17 in accordance with an embodiment of this invention. The exhaust gas recirculation system includes a conduit 48 that delivers exhaust gases from the exhaust manifold 21 to an exhaust gas recirculation (egr) valve, indicated generally by the reference numeral 49. The egr valve includes a valve element 51 that cooperates with a valve set 52 to control communication between the conduit 48 and a conduit 53 that delivers these exhaust gases to the intake manifold 31 at a point immediately downstream of the carburetor 24. The valve element 51 is controlled by means of a vacuum actuator indicated generally by the reference numeral 54. As is well known, the vacuum actuator includes diagram 55 that is connected to the valve element 51 in which divides the interior of the actuator into a upper chamber 56 and a lower chamber 57. The chamber 57 is vented to the atmosphere via a port 48 while the chamber 56 is provided with a vacuum signal for operating the valve element 51 through a conduit 59. The conduit 59 received an appropriate vacuum signal from an exhaust gas recirculating controlling valve, indicated generally by the reference numeral 61 and generally referred to as an egr amplifier. The vacuum supply for the accuater 54 is provided from a conduit 62 which is fed from a resevoir or accumulator 63 which, in turn, is charged by means of a conduit 66 that communicates with one or more of the cylinder head intake passages 22 via a check valve 67. The EGR amplifier is operated by means of signal ports that communicate with the primary carburetor barrel 25 just up stream of the idle position of the throttle valve 27 by means of a conduit 68 or at the primary barrel venturi by means of a conduit 69. Basically the egr valve 49 is operated so as to provide an amount of exhaust gas recirculation as will be depended upon the amount of vacuum transmitted to the chamber 56 by the egr amplifier 61.

In order to provide turbulence in the chamber 17 at low and partial loads and to improve the rate of combustion under these conditions, an auxilliary induction system is provided. The auxilliary induction system includes an intake port 71 formed in the valve block 34 in communication with each of the main intake passages 33. The port 71 feeds an auxilliary induction passage 72 formed in the valve block 34 and cylinder head 16 adjacent each main intake passage 22. The auxilliary induction passages 72 discharge again into the main induction passage 22 by means of a auxilliary intake port 73 that is just opposed to the head of the respective intake valve 23. The effective cross sectional area of the auxilliary induction passages and particularly the ports 73 is substantially less than that of the main induction passage. Thus, a given mass flow of charge passing through the auxilliary induction system will be delivered to the chamber 17 at a substantially greater velocity then if the same charge were to be delivered through the main induction passage. Thus, turbulence is increased in the chamber 17 particularly at the time of combustion through the use of the auxilliary induction system. If desired the auxilliary induction passage may be orinated as to promote a swirl in the chamber 17 in addition to turbulence. In the illustrated embodiment, the flow path is such that the intake charge will pass across the heated exhaust valve heads 19 before passing the spark plugs 35. This will aid in fuel vaporization to even further improve combustion efficiency. In order that the turbulence is maintained as well as swirl, if desired, the chamber 17 are smooth and relatively free of obstructions. To accomplish this, a hemispherical combustion chamber is provided and the pistons 15 are formed with substantially flat tops.

The valve block 34 supports a control valve 74 for each of its passages 73. The control valve 74 regulate the proportion of the charge entering the chamber 17 between the main and auxilliary induction passages. Each control valve 72 is affixed to a respective control valve shaft 74 that is operating by means of a actuator, indicated generally by the reference numeral 76, so as to provide an arrangement wherein a substantial portion of the engine idle and low load partial requirements are supplied through the auxilliary inducation system. As the load on the engine 12 increases, an increasing proportion of the charge requirements are supplied through the main induction passage.

Figure 4:
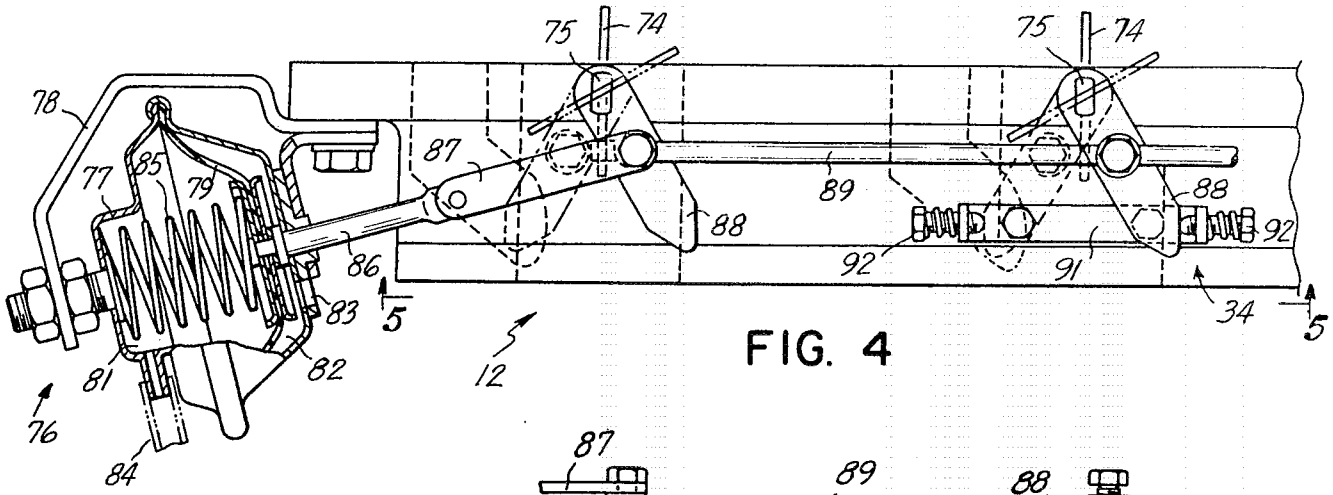
FIG. 4 is a side elevational view, with portions broken away, of the throttle accuating mechanism of the embodiment of FIGS. 2 and 3.
Figure 5:
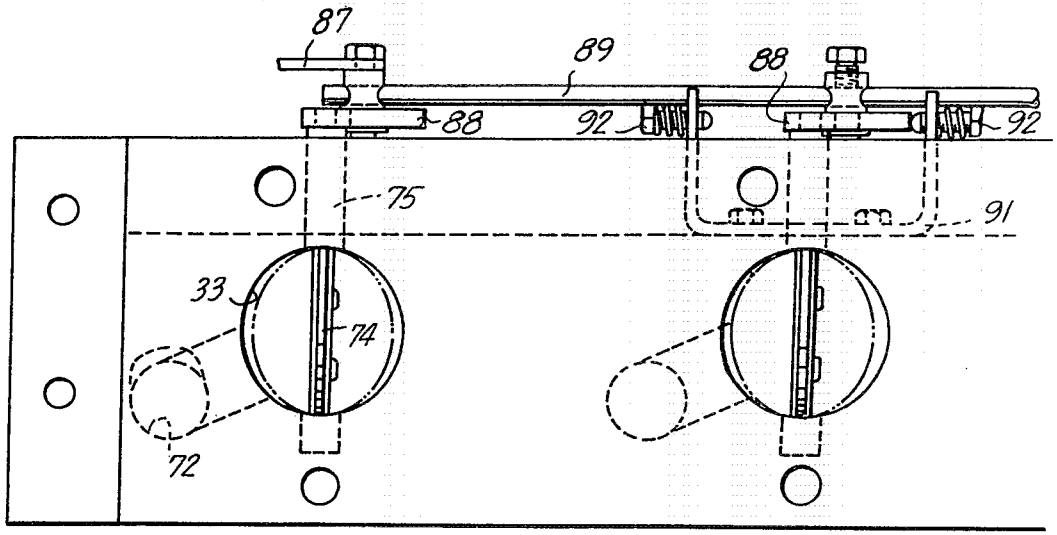
FIG. 5 is a bottom plan view of the throttle mechanism taken generally in the direction of the line 5—5 in FIG. 4.

The construction of the actuator 76 and its cooperation with the control valve 74 may be best understood by references to FIGS. 4 and 5. The actuator 76 includes a housing 77 that is supported on the valve block 34 by means of a bracket 78. A flexible diaphagm 79 positioned within the housing 77 divides the interior of the housing into first and second chambers 81 and 82. The chamber 82 is vented to the atmosphere by means of an atmospheric vent 83. The chamber 81 is exposed to the pressure in the induction system between the control valve 74 and the throttle valves 27 and 28 of the carburetor 24. Conduit 84 is provided for this purpose. As will become apparent, the arrangement is such that increased induction system vacuums will cause closure of the control valve 74 and an increase in the direction of the induction charge to the chamber 17 through the auxilliary induction passage 72. A spring 85 is positioned in the diaphram chamber 81 to act against the reduced pressure in this chamber and to urge the control valve 74 toward the fully opened position.

A rod 86 is connected to the diaphram 79 and is, in turn, pivotly connected to a throttle actuating link 87. The link 87 is pivotly connected at its opposite end to a lever 88 that is affixed to the throttle valve shaft 75 of the control valve 74 positioned closest to the actuator 76. A link or rod 89 connects the throttle valve control lever 77 with corresponding levers 88 which are affixed to the remaining control valves 74.

An arrangement is provided for limiting and adjusting the maximum possible degree of closure and of opening of the control valve 74. This mechanism comprises a U-shaped bracket 91 that is fixed to the valve block 34 adjacent one of the control valves 74. The bracket 91 has a pair of outwardly extending arms that are disposed on opposite sides of the position of the control valve lever 88 in its closed and opened positions, shown respectively by the dotted and solid line positions in FIG. 4. Adjustable screws 92 extend through each of these arms so as to provide an adjustment in the closed and opened positions of the control valve 74.

The operation of the embodiment of FIGS. 2 through 5 will now be described. When the engine is not running, atmospheric pressure will exist in both chambers 81 and 82 of the control valve actuator 76. The spring 85 will, therefore, urge the throttle valves 74 to their fully opened positions, as determined by the appropriate stop 92. At the same time, the EGR valve actuator 54 will experience atmospheric pressure in both of its chambers 56 and 57 and a spring 93 positioned in the chamber 56 will urge the valve element 51 to its closed position.

As soon as the engine fires and begins to run in an idling condition, a relatively high vacuum will be exerted in the induction system between the control valves 74 and the carburetor throttle valves 27 and 28. More specifically, the high negative pressure (low relative pressure) will exist down stream of the carburetor throttle valves 27 and 28. This low pressure will be transmitted through the conduit 84 to the control valve actuator chamber 81. The atmospheric pressure acting in the chamber 82 will, therefore, urge the diaphram 79 to the left and cause the control valves 74 to move toward the closed positions to a location determined by the adjustment of the appropriate stop 92. Thus, the intake charge for the engine chamber 17 will be delivered primarily through the auxilliary induction system consisting of the inlet port 71, passages 72 and ports 73. A high degree of turbulence will, therefore, be present in the chamber 17 at the time of firing of the spark plugs 35. This will improve the rate of flame propogation. As has been previously noted, swirl may also be generated at this time.

The effect of this condition may be understood again by reference to FIG. 1. As has been previously noted, with a conventional engine the desired or demanded spark advance at idling is in the range of 25 to 35 degrees before top dead center (line e). The distributor 36, however, provides a retarded spark to avoid pre-ignition at higher engine loads. Thus, it provides approximately 15 degrees spark advance as represented by the line b. The effect of the increased turbulence is to decrease the demand advance or optimum advange at idling to a point represented by the dotted line curve j. It will be seen, therefore, that the spark advance characteristic provided by a conventional distributor having only a governor advance when used in conjunction with this invention provides a spark much closer to the optimum point than would be possible with conventional engines.

As the load on the engine increases, a higher and higher velocity of flow will occur through the auxilliary induction system. At the same time, the throttle valve 72 will have been opened sufficiently so that the EGR amplifier port served by the conduit 68 will be down stream of this throttle valve, thus, the valve element 51 will open introducing exhaust gases into the induction system. These exhaust gases will be delivered in large part through the auxilliary induction system and further increases the velocities of flow through this sytem. A situation may occur, therefore, where combustion occurs so rapidly in the chamber 17 that efficiency is lowered and fuel combustion increases. In order to prevent this condition, the control valves 74 are adjusted by the adjusting device 92 so that there is a pre-determined minimum opening of these valves and, accordingly, at least a portion of the charge requirements at additional and low load will be supplied additionally through the main induction passage 22. This has the effect of retarding the rate of combustion and making the advanced characteristic of the distributor 36 more closely approach the optimum. In accordance with a specific embodiment of the invention, the initial or opening of the control valves 74 was set between 5 and 20 degrees and preferably at 15 degrees.

As has been noted, the introduction of exhaust gas further increases the rate of induction velocity. However, since the exhaust gases do not provide a combustible mixture or any significant necessary components of it, they have the effect of slowing down the combustion. Thus, by introducing a larger amount of exhaust gas under partial load conditions than with conventional engines the combustion speed may be controlled so as to achieve the desired results. In accordance with a specific embodiment of the invention, the amount of exhaust gas recirculated at partial loads lies in the range of 6 to 20% of the total intake volume. This has been found to provide a demand spark advance which very closely approximates that provided for by a distributor with a conventional governor advance. This has the effect of simplifying the distributor construction since a vacuum advance device need not be incorporated.

As the load on the engine increases, eventually the vacuum downstream of the throttle valves 27 and 28 will no longer be sufficient to overcome the action of the spring 85 of the actuator 76 and the control valve 72 will be progressively opened. Thus, an increasing proportion of the engine charge requirements will be supplied through the main induction system.

As is also well known, the EGR amplifier 61 will operate to provide an increasing amount of exhaust gas recirculation either via the port served by the conduit 68 or the venturi port served by the conduit 69. At maximum output, the amplifier 61 will discontinue the vacuum signal to the actuator chamber 56 so as to close the valve element 51 and stop exhaust gas recirculation.

Figures 6, 7:
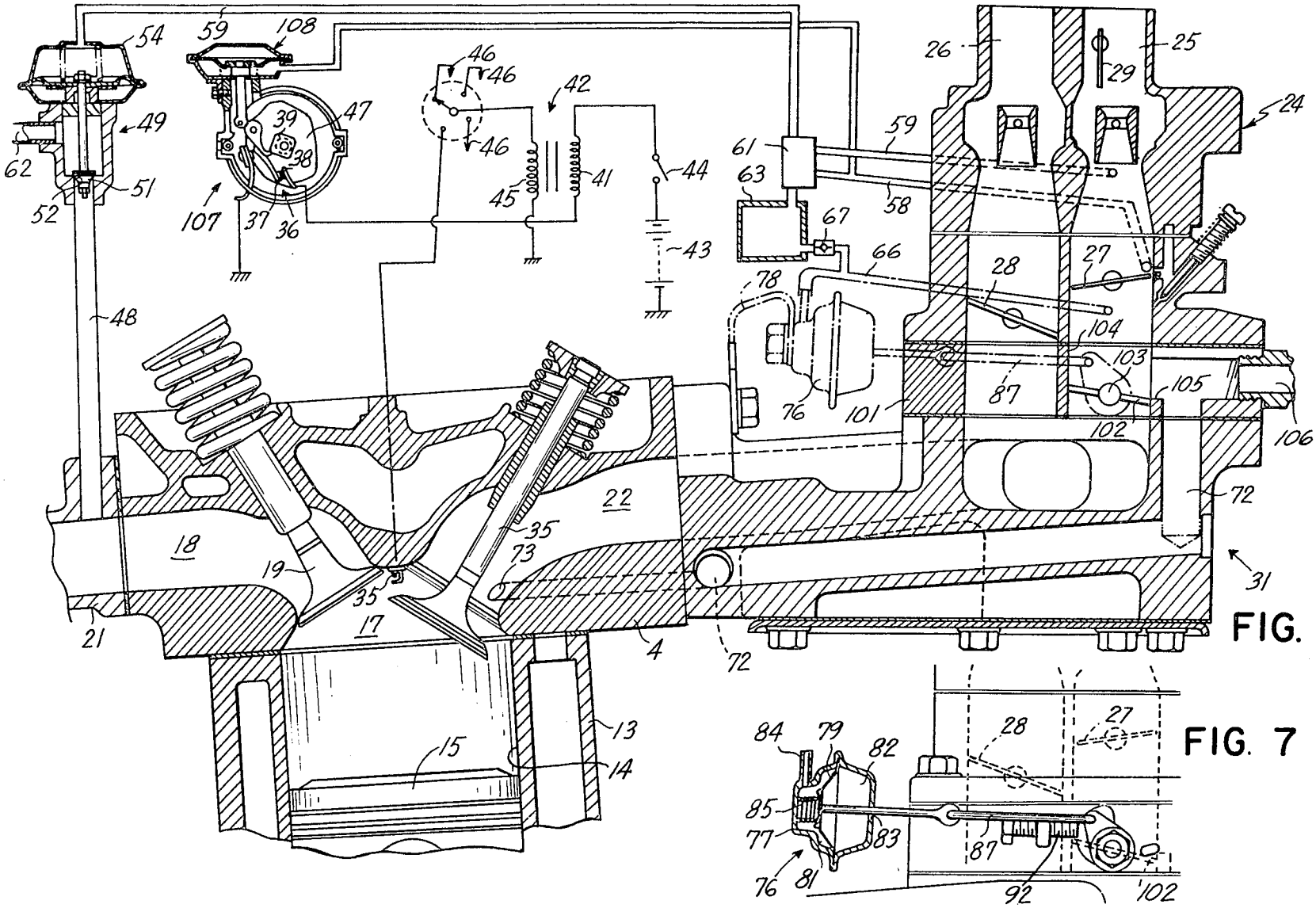
FIG. 6 is a cross sectional view in part similar to FIG. 2, showing another embodiment of the invention.
FIG. 7 is a view of the throttle accuating mechanism of the embodiment of FIG. 6, with portions broken away.
Figure 8:
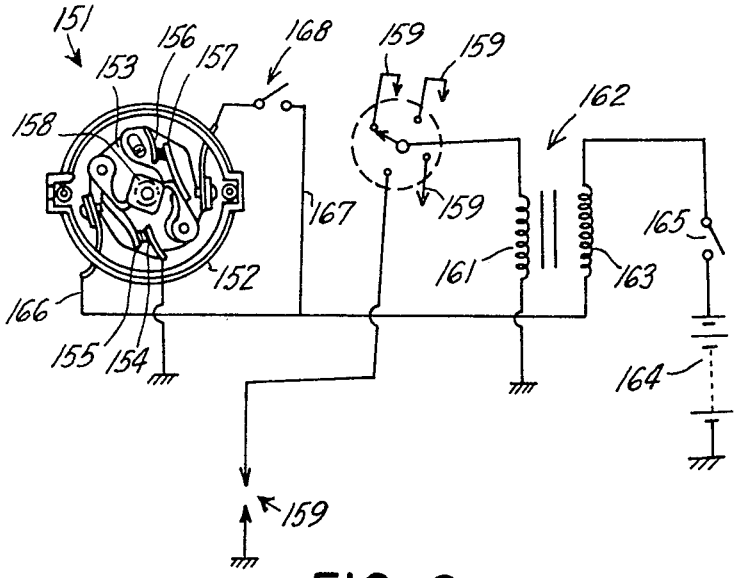
FIG. 8 is a partially schematic view of a spark advance and distributor mechanism constructed in accordance with another embidoment of the invention.

THE EMBODIMENT OF FIGS. 6 and 7

FIGS. 6 and 7 illustrate another embodiment of the invention generally similar to the embodiment of FIGS. 2 through 5. In view of the similarity parts that are the same as the previously described embodiment or which function in the same manner have been identified by the same reference numeral and will not be described again. In conjunction with this embodiment, a control valve block 101 is interposed directly between the intake manifold 31 and the carburetor 24 rather than between the intake manifold and the cylinder head as in the previously described embodiment. Thus, only a single control valve 102 need be supported upon a control valve shaft 103 in the main intake passage 104 of the valve block 101. A common intake port 105, may, therefore, be supplied for all of the auxilliary induction passages 72. This simplifies the construction but has the effect of lowering the rate of velocity of discharge of the induction gases through the auxilliary induction system. Thus, in conjunction with this embodiment it is necessary to provide substantially no initial opening for the control valve 102 so as to retard the rate of combustion at partial load conditions. This is partially because there is a relatively large volume of air trapped between the control valve 102 and the intake valves 35 in the main induction passage. This trapped air is partially inducted into the engine upon opening of the intake valves 35.

In conjunction with this embodiment, the exhaust gases that are recirculated are also delivered directly into the auxilliary induction system via a port and fitting 106. This further has the rate of reducing the combustion velocity and may, if desired, permit the use of a distributor 107, having a conventional vacuum spark advance mechanism 108 in addition to it conventional mechanism.

Figure 9:
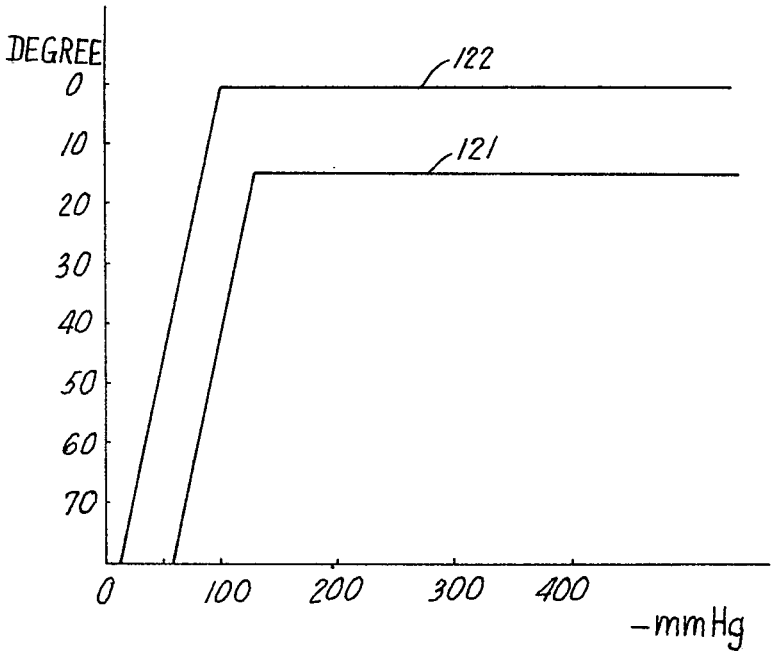
FIG. 9 is a diagramatic illustration of the throttle movement in the embodiment of FIGS. 2–5 and 6 and 7.

FIG. 9 illustrates the rate of opening the control valves 14 and 102 of the embodiments of FIGS. 2 through 5 and 6 and 7 in relation to induction system vacuum. In this illustration, the degree of control valve opening is indicated by the absessa and intake manifold vacuum is indicated on the ordinate. The curve 121 represents the characteristics of the control valve in the embodiment of FIGS. 2 through 5 whereas the curve 122 indicates the characteristics of the control valve 102 of the embodiment of FIGS. 6 and 7. With each embodiment, it will become apparent that as the load on the engine increases, induction vacuum decreases, the control valves are rapidly opened so as to provide an increasing proportion of the charge requirements through the main induction system. This is possible without adversely effecting combustion efficiency due to the fact that induction system velocities will be high enough under these running conditions through the large main induction system so as to have good combustion. Furthermore, volumetric efficiency is not reduced in this manner.

EMBODIMENT OF FIGURE 8

In some instances it may be desirable to provide a variation in the spark advance in relation to the position of the manually operated throttle valve of the engine. A distributor and ignition circuit achieving this result is shown in this Figure. In conjunction with this embodiment, portions of the distributor are shown graphically and other portions are shown schematically. The distributor is indicated generally by the reference numeral 151 and includes a housing 152 having a plate 153 on which a first set of points consisting of a fixed point 154 and a moveable point 155 and supported. Angularly related to the points 154 and 155 is a second set of points, also supported by the plate 153. This second set of points consists of a fixed point 156 and a moveable point 157. The moveable points 155 and 157 are operated by means of a cam 158 carried on the driven distributor shaft. The plate 153 may be operated to provide a governor type advance.

In conjunction with this embodiment, the points 154 and 155 provide a significantly less advance than do the points 156 and 157 due to the angular locations.

A rotor coupled with the shaft 158 cooperates with a distributor cap to provide a timed spark to the spark plugs via conductors 159. This spark is generated by the secondary winding 161 of a coil indicated generally by the reference numeral 162. Primary winding 163 of the coil is in circuit with a battery 164 via an ignition switch 165. The opposite side of the primary winding 163 is connected by means of a conductor 166 to the moveable point 155 of the point set 154,155. Another conductor 167 connects the opposite side of the primary coil winding 163 with the moveable point 157 of the point set 156,157 by manes of a switch 168. The switch 168 is connected with the actuating mechanism of the throttle valve of the associated engine so that it will be closed at a predetermined degree of throttle opening.

This embodiment operates, therefore, on a reduced or retarded spark advance curve during the time the switch 168 is opened and the spark timing is controlled by the set of points 154,155. When the switch 168 is closed, however, the more advanced spark offered by the points set 156,517 will be provided.

It should be readily apparent that, although the invention has been described in conjunction with embodiments in which the charge is supplied by a carburetor, all features of this invention are equally adaptable with fuel injected, spark ignition engines. It is believed that those skilled in the art will readily know how to apply the disclosed principles to that type of engine. Also, even though the invention has been described in conjunction with reciprocating engines, it is equally applicable to rortary engines.

It is also believed obvious to those skilled in the art that this invention and the various embodiments of it improve combustion efficiency, particularly at low and partial loads while making the use of conventional or simplified distributor arrangements possible.

Various changes and modifications in addition to those described may be made without departing from the scope of the invention as defined by the appended claims.

We claim:

1. In a spark ignited internal combustion engine having a variable volume chamber in which combustion occurs, a spark plug for firing a charge in said chamber, a distributor for delivering an electrical charge at a timed interval to said spark plug for firing said spark plug, said distributor including only governor advance means for varying the time of delivery of a charge to said spark plug in response to the speed of the engine, said governor advance means providing a fixed time of spark firing at least at certain engine speeds below a predetermined speed, the improvement comprising means for increasing the turbulence in said variable volume chamber at speeds less than the predetermined sufficiently to cause the rate of combustion in said chamber to produce efficient running at the fixed time of spark firing.

2. A spark ignited internal combustion engine as set forth in claim 1 wherein the means for increasing the turbulence constitutes means for delivering an intake charge to the chamber at a high velocity.

3. A spark ignited internal combustion engine as set forth in claim 2 wherein the means for delivering the intake charge at a high velocity comprises a relatively small cross-sectional area auxiliary induction passage.

4. A spark ignited internal combustion engine as set forth in claim 3 further including a relatively large main induction passage for delivering a charge to the variable volume chamber and valve means for controlling the ratio of communication of said passages with said chamber.

5. A spark ignited internal combustion engine as set forth in claim 4 wherein the valve means is responsive to the load on the engine for delivering a substantial portion of the idle and low-load charge requirements to the chamber throughout the auxiliary induction passage and a substantial portion of the full load charge requirements throughout the main induction passage.

6. A spark ignited internal combustion engine as set forth in claim 2, 3 or 5 further including means for retarding the rate of combustion in the chamber at least at speeds below the predetermined speed for further controlling the rate of combustion.

7. A spark ignited internal combustion engine as set forth in claim 6 wherein the means for controlling the rate of combustion comprises means for introducing a controlled amount of exhaust gases to the chamber prior to combustion.

8. A spark ignited internal combustion engine as set forth in claim 2, 3 or 5 further including means for introducing a non-turbulent charge to the chamber along with the turbulent charge to control the degree of turbulence.

9. The method of operating a spark ignited internal combustion engine having a variable volume chamber in which combustion occurs, a spark plug for firing a charge in said chamber, a distributor for delivering an electrical charge at a timed interval to said spark plug for firing said spark plug, said distributor including only governor advance means for varying the time of delivery of a charge to said spark plug in response to the speed running characteristic of the engine, said advance means providing a fixed time of spark firing at speeds below a predetermined speed, comprising the step of increasing the turbulence in the variable volume chamber at at least certain speeds below the predetermined speed sufficiently to cause the rate of combustion in said chamber to produce efficient running at the fixed time of spark firing.

10. A spark ignited internal combustion engine as set forth in claim 9 wherein the turbulence is increased by introducing at least a portion of the intake charge through a relatively small cross-sectional area intake passage.

11. A spark ignited internal combustion engine as set forth in claim 9 further including the step of reducing the rate of combustion.

12. A spark ignited internal combustion engine as set forth in claim 11 wherein the rate of combustion is reduced by introducing a noncombustible mixture to the intake charge.

13. A spark ignited internal combustion engine as set forth in claim 11 wherein the rate of combustion is reduced by introducing a nonturbulent charge along with the turbulent charge.

* * * * *